United States Patent [19]

Sumii et al.

[11] Patent Number: 4,686,132

[45] Date of Patent: Aug. 11, 1987

[54] CLEANING WEB FOR FIXING ROLLS ON COPY MACHINES

[75] Inventors: Yoshiyuki Sumii, Moriyama; Soshichi Fukaya, Hikone, both of Japan

[73] Assignee: Japan Vilene Co., Ltd., Tokyo, Japan

[21] Appl. No.: 719,012

[22] Filed: Apr. 2, 1985

[51] Int. Cl.[4] ..... B32B 5/14

[52] U.S. Cl. ..... 428/171; 15/104.93; 428/198; 428/287; 428/288; 428/290; 428/902

[58] Field of Search ..... 428/171, 198, 288, 902, 428/287; 15/104.93

[56] References Cited

U.S. PATENT DOCUMENTS

| | | | |
|---|---|---|---|
| 4,143,197 | 3/1979 | Jasionowicz et al. | 428/902 |
| 4,333,979 | 6/1982 | Sciaraffa et al. | 428/198 |
| 4,359,132 | 11/1982 | Parker et al. | 428/288 |
| 4,433,493 | 2/1984 | Poisson | 428/902 |
| 4,446,203 | 5/1984 | Okuba et al. | 428/288 |

FOREIGN PATENT DOCUMENTS

| | | | |
|---|---|---|---|
| 2303328 | 7/1973 | Fed. Rep. of Germany | 428/198 |
| 2031039 | 4/1980 | United Kingdom | 428/171 |

*Primary Examiner*—George F. Lesmes
*Assistant Examiner*—P. R. Schwartz
*Attorney, Agent, or Firm*—Pahl, Lorusso & Loud

[57] ABSTRACT

A cleaning web for fixing roll of copy machines, the cleaning web consisting of a fibrous base material containing 20 to 85 wt % of aromatic polyamide fibre and 80 to 15 wt % of polyester fibre and having seal portions and non-seal portions with an apparent density of 0.2 to 0.4 g/cm$^3$ distributed substantially over the entire area thereof, the fibrous base material being impregnated with silicone oil.

11 Claims, 3 Drawing Figures

CLEANING WEB FOR FIXING ROLLS ON COPY MACHINES

BACKGROUND OF THE INVENTION (i) Field of the Invention

This invention relates to a cleaning web for fixing rolls on copy or duplicator machines.

Generally, toner deposition on a fixing roll of a copy machine results in contamination of copied prints or adhesion of a copy sheet around the fixing roll due to the resin components of the toner. Therefore, it has been the conventional practice to remove the toner by contacting a fixing roll with a cleaning member in the form of a blade, roll, web or the like. However, such cleaning means are often found to have insufficient cleaning effect, failing to exfoliate the toner which tends to cling to the surface of a fixing roll.

(ii) Description of the Prior Art:

In this connection, Japanese Laid-Open Patent Application No. 199371/1983 discloses a cleaning web impregnated with silicone oil, which is superior to other cleaning means in cleaning effects, since it can easily exfoliate toner from the fixing roll surface by the use of the releasing action of silicone oil and it can be transported to use always provide a fresh cleaning surface. However, for use with a transport mechanism, the cleaning web is required to have a certain strength and needs calendering to provide smooth surfaces with an apparent density higher than 0.4 g/cm$^3$. Consequently, the cleaning web of this sort is limited in the amount of impregnated silicone oil as well as in the amount of toner which can be collected by the web, and it has an inherent drawback that copied prints are often contaminated due to an insufficient supply of silicone oil or incomplete removal of toner in continuous copying operations or in copying operations involving prints of heavy tones. Besides, the conventional web is inferior in cushioning effect, so that, if pressed against a fixing roll to transfer silicone oil onto the roll surface, it may damage or accelerate wear of a resin layer of polytetrafluoroethylene which is coated on the fixing roll surface.

SUMMARY OF THE INVENTION

It is therefore an object of the present invention to overcome the drawbacks or problems of the above-mentioned prior art, and more specifically to provide a cleaning web for fixing rolls on copy machines, which can remove toner even in continuous copying operations and in production of heavy tone prints and which can suitably prevent adhesion and contamination of copy sheets.

In order to achieve these objectives, the present invention provides a cleaning web for fixing rolls of copy machines, the cleaning web having a fibrous base material containing 20 to 85 wt % of aromatic polyamide fibre and 80 to 15 wt % of polyester fibre and having sealed portions and non-seal portions with an apparent density of 0.2 to 0.4 g/cm$^3$ distributed substantially over the entire area thereof the fibrous base material being impregnated with silicone oil.

The above and other objects, features and advantages of the invention will become apparent from the following description and the appended claims, taken in conjunction with the accompanying drawings which show by way of example preferred embodiments of the invention.

DESCRIPTION OF PREFERRED EMBODIMENTS

Figure 1:
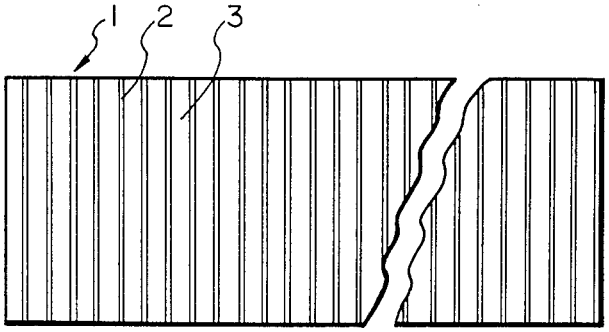
FIG. 1 is a plan view of a cleaning web embodying the present invention.

Referring to the drawings and first to FIG. 1, there is illustrated in plan view a cleaning web 1 embodying the present invention, which is constituted by a fibrous base material in the form of woven fabric, felt, non-woven fabric or the like containing 20 to 85 wt % of aromatic polyamide fibre and 80 to 15 wt % of polyester fibre and having sealed portions 2 formed prior to impregnation with silicone oil, or by a non-woven fabric with sealed portions, formed by hot-pressing a mixture of 20 to 85 wt % of aromatic polyamide fibre and 80 to 15 wt % of polyester fibre and impregnated with silicone oil.

Examples of the aromatic polyamide fibre to be used in the present invention include polymetaphenylene isophthalamide fibre and polyparaphenylene terephthalamide fibre. The fibrous base material should contain more than 20 wt % of aromatic polyamide fibre to provide heat resistance which is necessary for cleaning the fixing roll along with dimensional stability at high temperatures. Examples of polyester fibre include polyethylene terephthalate fibre, polybutylene terephthalate fibre, polyethylene terephthalate/isophthalate copolymer fibre and the like. In order to impart necessary strength to the cleaning web by forming the sealed portions, the fibrous base material should contain more than 15 wt % of polyester fibre. According to the present invention, the polyester fibre is mainly used as bonding fibre for forming the sealed portions, and therefore it is desired to be an undrawn polymer which provides bonding, preferably by hot pressing at a temperature of 180° to 230° C. and a linear pressure of 10 to 50 Kg/cm. In this regard, it is to be noted that all the polyester fibre contained in the fibrous base material is not necessary for bonding under the above-mentioned hot pressing conditions, and may include non-bonding fibre as long as the content of the bonding fibre is larger than 15 wt %. Further, the cleaning web which is brought into contact with a fixing roll with a surface temperature of 180° to 210° C. during operation is preferred to have a melting point higher than at least 210° C.

The fibrous base material to be used in the present invention is formed with sealed portions 2 and non-seal portions 3 by hot pressing with an embossed roll. The base material is securely and tightly bonded in the sealed portions 2 by the thermal bonding property of the polyester fibre, and has a coarse construction with less bonding points of the polyester fibre in the non-seal portions 3. The non-seal portions 3 has an apparent density of 0.2 to 0.4 g/cm$^3$. An apparent density in excess of 0.4 g/cm$^3$ will result in a cleaning web which has an insufficient oil holding capacity and which is inferior in cushioning effect. On the contrary, an apparent density smaller than 0.2 g/cm$^3$ will result in a cleaning web which lacks strength and abrasion resistance. Preferably, the non-seal portions 3 should have an apparent density in the range of 0.25 to 0.35 g/cm$^3$.

As a result of distribution of the sealed portions 2 and non-seal portions 3, raised or depressed portions are formed on the surface of the cleaning web 1. Therefore, the cleaning web 1 can exfoliate toner from the surface of a fixing roll more efficiently as compared with conventional cleaning webs with flat and smooth surfaces, coupled with an advantage that the depressed portions increase the amount of toner collection per unit area. In addition, as the surface area is increased by formation of the raised and depressed portions, the transfer of silicone oil from the cleaning web 1 to the surface of a fixing roll can be improved to a significant degree.

Figure 2:
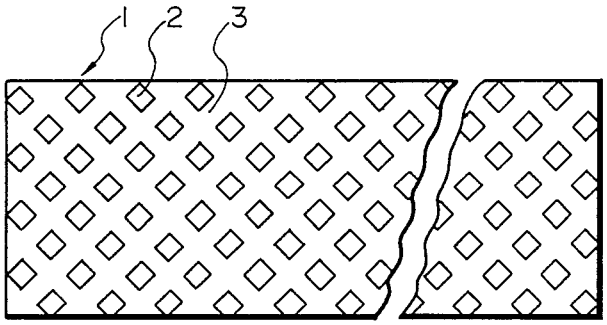
FIG. 2 is a view similar to FIG. 1 but showing another embodiment of the invention.

As illustrated in FIG. 1, the sealed portions 2 are preferred to be in the form of lines or stripes extending perpendicular to the longitudinal direction of the cleaning web 1, in consideration of its toner removing and collecting effects. The lines or stripes of the sealed portions 2 may be formed in discontinuous or sinusoidal shapes if desired. Alternatively, the seal portions 2 of cubic, rectangular, rhombus, circular or other specific shapes may be uniformly distributed in the manner as shown particularly in FIG. 2. In consideration of the longitudinal and transverse dimensions of the cleaning web, seal portions 2 are preferred to have greater dimensions in the transverse direction for the purpose of enhancing their toner removing and collecting effects.

The proportion of the surface area of the seal portions 2 in the total area of the cleaning web 1 is preferred to be greater than 10% to secure the strength necessary for application to a web transport mechanism, and to produce sufficient toner collecting effect. Further, from the standpoint of the cushioning effect of the cleaning web, it is desirable to be smaller than 40%. An especially preferred areal amount for the sealed portions 2 is 20 to 30%.

The silicone oil which is useful in the present invention contains polydimethylsiloxane as its major component and desirably has a viscosity of 5,000 to 30,000 centistokes at room temperature. This is because the cleaning web impregnated with the silicone oil is contacted with a fixing roll with a surface temperature of 180° to 240° C. in use and, if the viscosity at room temperature is lower than 5,000 centistokes, the oil is fluidized too much and fed to the fixing roll excessively, inviting contaminations of the fixing roll or other component parts of a copy machine. On the other hand, if the viscosity at room temperature is higher than 30,000 centistokes, it becomes difficult to supply a fixing roll with a necessary amount of silicone oil. Impregnation of the silicone oil in the cleaning web at an amount smaller than 20 g per square meter of web is reflected by insufficient toner removal, while impregnation with an amount in excess of 55 g/m$^2$ results in overfeeding and incapability of retaining the oil in the cleaning web under the influence of the heat which is received from the fixing roll during operation. Accordingly, the amount of silicone oil impregnation is preferred to be in the range of 25 to 55 g per square meter of web.

Figure 3:
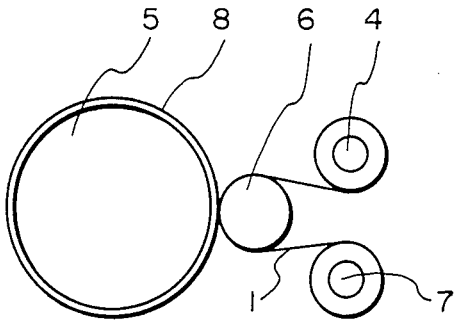
FIG. 3 is a partly sectioned view of a fixing mechanism of a copy machine, incorporating the cleaning web of the invention.

As an example of application, FIG. 3 shows in partly sectioned view a fixing mechanism of a copy machine incorporating a cleaning web 1 according to the invention, wherein a cleaning web 1 which is wound on a spool 4 is passed between a fixing roll 5 and a press roll 6 and taken up on a take-up shaft 7 which is driven from a motor or other suitable means. In this instance, the press roll 6 presses the cleaning web 1 against the fixing roll 5 with a predetermined pressure to remove toner from the fixing roll surfaces. The pressed cleaning web 1 transfers the silicone oil onto the surfaces of the fixing roll in an amount sufficient for loosening the toner, while the toner on the fixing roll surfaces is removed by the raised and depressed portions formed on the surface of the cleaning web 1, i.e. sealed and non-sealed portions 2 and 3.

The cleaning web 1 containing bulky non-seal portions 3 with an apparent density of 0.2 to 0.4 g/cm$^3$ has excellent cushioning effect, so that it has no possibility of damaging the layer of polytetrafluoroethylene on the surface of the fixing roll or accelerating its abrasive wear when pressed thereagainst by the press roll 6. Further, as the cleaning web 1 is transported by the winding-up action of the take-up shaft 7 as described hereinbefore, the fixing roll is always contacted with a fresh surface of the cleaning web 1.

It will be appreciated from the foregoing description that cleaning web according to the present invention is extremely useful since it ensures production of clear contamination-free copies and prevents entangling of copy sheets on the fixing roll, coupled with an advantage that it can prolong the service life of the fixing roll since the polytetrafluoroethylene layer on the surface of the fixing roll is less susceptible to abrasive wear.

EXAMPLE 60 wt % of polymethaphenilene isophthalamide fibre of 1.5 denier was mixed with 40 wt % of undrawn polyethylene terephthalate fibre of 3.0 denier, and formed into non-woven fabric by an embossing roll of diagonal pattern employing a temperature of 220° C. and a linear pressure of 30 Kg/cm. The resulting non-woven fabric contained a distribution of rhombus seal portions at an areal ratio 28%, with fibre distribution of 30 g/m$^2$ and an apparent density of 0.33 g/cm$^3$ for the non-sealed portions. This non-woven fabric was impregnated with silicone oil of 10,000 centistokes to obtain a cleaning web.

The cleaning web, with a silicone oil impregnation amount as much as 45 g per square meter of web, was mounted on a copy machine for a test, in which the silicone oil was transferred from the cleaning web to the fixing roll surface at an amount of 31.5 g per square meter of web, that is to say, at a transfer rate of 70%.

Accordingly, the cleaning web could exfoliate the toner sufficiently and remove same even in continuous copying operations and production of heavy tone copies.

COMPARISON EXAMPLE

Web of the same fibre mixture as in the foregoing example was hot-pressed into non-woven fabric by means of a calender roll employing a temperature of 220° C. and a linear pressure of 10 Kg/cm. The resulting non-woven fabric had a flat and smooth surface, with a fibre distribution of 30 g/m$^2$ and an apparent density of 0.5 g/cm$^3$. This non-woven fabric was impregnated with silicone oil of 10,000 centistokes, same as in the foregoing example, to obtain a cleaning web.

The cleaning web, with a silicone oil impregnation amount as low as 20 g per square meter of web, was mounted on a copy machine for a test, in which the silicone oil was transferred from the cleaning web to a fixing roll at an amount of 13.3 g per square meter of web, that is to say, at a transfer rate of 67%.

Consequently, the use of the cleaning web resulted in deficient silicone oil supply and insufficient exfoliation of the toner, which remained on the fixing roll surface in the case of production of heavy tone prints and in a continuous copying operation, thus contaminating copy sheets.

What is claimed is:

1. A cleaning web for fixing rolls of copy machines, said cleaning web comprising a fibrous base material containing 20 to 85 wt % of aromatic polyamide fibre and 80 to 15 wt % of polyester fibre and having an embossed pattern with (a) sealed portions and (b) non-sealed portions with an apparent density of 0.2 to 0.4 $g/cm^3$ distributed substantially over the entire area thereof, the fibrous base material being impregnated with 25-55 $g/m^2$ silicone oil.

2. The cleaning web of claim 1, wherein said sealed portions constitute 10 to 40% of the total surface area of said web.

3. The cleaning web of claim 2 wherein said web is impregnated with silicone oil with a viscosity of 5,000 to 30,000 centistokes.

4. The cleaning web of claim 1, wherein said web is impregnated with silicone oil with a viscosity of 5,000 to 30,000 centistokes.

5. The web of claim 1 wherein said sealed portions are continuous lines extending across the width of the web.

6. The web of claim 1 wherein said sealed portions are areas of dimensions substantially smaller than the width of the fabric and uniformed distributed throughout the width and length of the fabric.

7. The web of claim 6 wherein the dimension of said sealed portions traverse to the length of the fabric is greater than that parallel to the length of the fabric.

8. The web of claim 1 wherein said polyester fibre is undrawn.

9. The cleaning web of claim 1 wherein said silicone oil has a viscosity of 5,000 to 30,000 centistokes at room temperature.

10. The cleaning web of claim 1 wherein said polyester is selected from the group consisting of polyethylene terephthalate, polybutylene terephthalate and polyethylene terephthalate/isophthalate copolymer.

11. The cleaning web of claim 1 wherein said aromatic polyamide is a member selected from the group consisting of polymetaphenylene isophthalamide and polyparaphenylene terephthalamide.

* * * * *